US006446885B1

(12) United States Patent
Sims, Jr. et al.

(10) Patent No.: US 6,446,885 B1
(45) Date of Patent: Sep. 10, 2002

(54) SECONDARY FILTER ASSEMBLY FOR FUEL INJECTOR

(75) Inventors: Dewey M. Sims, Jr., Wayne, MI (US); Werner A. Schelling, Charleston, SC (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/681,128

(22) Filed: Jan. 16, 2001

(51) Int. Cl.[7] ..... F02M 51/00
(52) U.S. Cl. ..... 239/585.4; 251/129.15
(58) Field of Search ..... 239/585.1, 585.4; 251/129.21, 129.15

(56) References Cited

U.S. PATENT DOCUMENTS

| | | | | |
|---|---|---|---|---|
| 4,311,168 A | | 1/1982 | Peters et al. | |
| 4,798,329 A | | 1/1989 | Mesenich | |
| 4,832,077 A | | 5/1989 | Pilolla | |
| 5,088,650 A | | 2/1992 | Takagi et al. | |
| 5,192,048 A | * | 3/1993 | Wakeman | 239/585.3 |
| 5,238,192 A | | 8/1993 | McNair | |
| 5,330,649 A | | 7/1994 | Hafner | |
| 5,335,863 A | | 8/1994 | DeGrace | |
| 5,692,723 A | * | 12/1997 | Baxter et al. | 137/550 |
| 6,015,103 A | * | 1/2000 | Kotkowicz | 239/533.11 |
| 6,279,841 B1 | * | 8/2001 | McCormick | 137/625.65 |

* cited by examiner

*Primary Examiner*—Lesley D. Morris
(74) *Attorney, Agent, or Firm*—Michael Best & Friedrich LLP

(57) ABSTRACT

A fuel injector including a jacket, a valve seat, and a needle valve apparatus mounted within the jacket and engagable with the valve seat. The needle valve apparatus includes a plurality of holes for filtering fuel flowing through the injector. Each of the holes has a diameter sized to prevent passage therethrough of particles having widths of approximately 0.050 millimeters and larger. In one aspect of the invention, the needle valve apparatus includes a needle valve assembly having at least one transverse aperture through which fuel can flow and a generally tubular filter surrounding at least a portion of the needle valve assembly. The plurality of holes for filtering fuel is formed in the tubular filter. In another aspect, the needle valve apparatus includes a needle valve assembly having a needle valve with a wall that includes the plurality of holes.

34 Claims, 3 Drawing Sheets

SECONDARY FILTER ASSEMBLY FOR FUEL INJECTOR

BACKGROUND OF INVENTION

The invention relates to fuel injectors, and more particularly to fuel filters in fuel injectors.

In modern fuel-injected internal combustion engines, electromagnetic fuel injectors deliver fuel to the engine in metered pulses that are appropriately timed to the engine operation. To produce the metered pulses of fuel, electromagnetic fuel injectors typically include a valve member that is actuated by an electromagnetic coil to open and close the fuel valve. When the fuel valve is open, fuel is injected into the air/fuel mixing chamber and then into the combustion chamber to power the vehicle as is commonly understood. Of course, the fuel can also be injected directly into the combustion chamber.

It is desirable to filter the fuel as it enters the fuel injector to help insure the smooth operation of the fuel injector. Primary fuel filters are commonly used to filter debris contained in the fuel and to prevent the debris from getting stuck between the valve needle and the valve seat, which would cause the injector to remain stuck in the: open position. For example, U.S. Pat. Nos. 4,798,329, 5,238,192, 5,330,649, and 5,335,863 disclose various primary fuel filter arrangements in which a fuel filter is located at or near the point at which the fuel enters the fuel injector.

Aside from the debris originally contained within the fuel, the fuel can pick up additional debris as it passes through the fuel injector. This additional debris is produced during the manufacturing of the fuel injector and includes extremely small particles that cannot be completely removed after the manufacturing process is complete. This additional debris is also capable of hampering the proper operation of the fuel injector and should be filtered. Various secondary fuel filters have been used in an attempt to filter the additional debris picked up by the fuel as the fuel travels through the fuel injector.

SUMMARY OF INVENTION

With known secondary filter assemblies, particulate contaminants within the fuel may pass through the filter or bypass the filter completely to lodge between the valve needle and the valve seat, causing the valve to stick open and deliver fuel to an engine throughout the combustion cycle. This often occurs due to the improper or incomplete seal between the secondary filter and the supporting components of the fuel injector. The poor sealing characteristics can be inherent in the design of the secondary filter, can be caused by improper assembly of the secondary fuel filter in the fuel injector, or can be attributed to a combination of the design and the assembly. Efforts to improve the sealing characteristics have resulted in prior art secondary filter assemblies that are difficult and expensive to manufacture and assemble.

The present invention provides an improved secondary filter assembly for a fuel injector. The secondary filter assembly of the present invention is located as close to the downstream end of the fuel injector as possible to capture substantially all of the additional debris. In light of the downstream location, the design of the secondary filter assembly has been optimized to minimize the pressure drop across the secondary filter, thereby substantially preventing fuel vaporization the could otherwise result in hot restart problems.

In one embodiment of the present invention, the secondary filter assembly includes a tubular filter in the form of a screen that surrounds the needle portion of the needle valve assembly. Fuel is filtered as it passes through the apertures in the needle, just prior to injection. This first embodiment is easier and less expensive to manufacture and assemble than prior art secondary filter assemblies, yet does a substantially better job of filtering particulate and maintaining the proper operation of the fuel injector. One reason for the improvement is that the filter screen is designed to be self-sealing upon assembly. More specifically, the filter includes at least one end that is forced against and deflected by a surface of the needle valve assembly to form a seal between the end of the filter and the needle valve assembly. Preferably, the end of the filter includes a plurality of finger-like tabs that are deflected by the surface of the needle valve assembly to substantially seal and secure the end of the filter to the needle valve assembly.

In a second embodiment of the present invention, the secondary filter is integrally formed in the needle by laser drilling or otherwise forming thousands of small holes directly in the needle itself, thereby-eliminating the need for a separate filter screen surrounding the needle.

Other features and advantages of the invention will become apparent to those skilled in the art upon review of the following detailed description, claims, and drawings.

Figure 1:
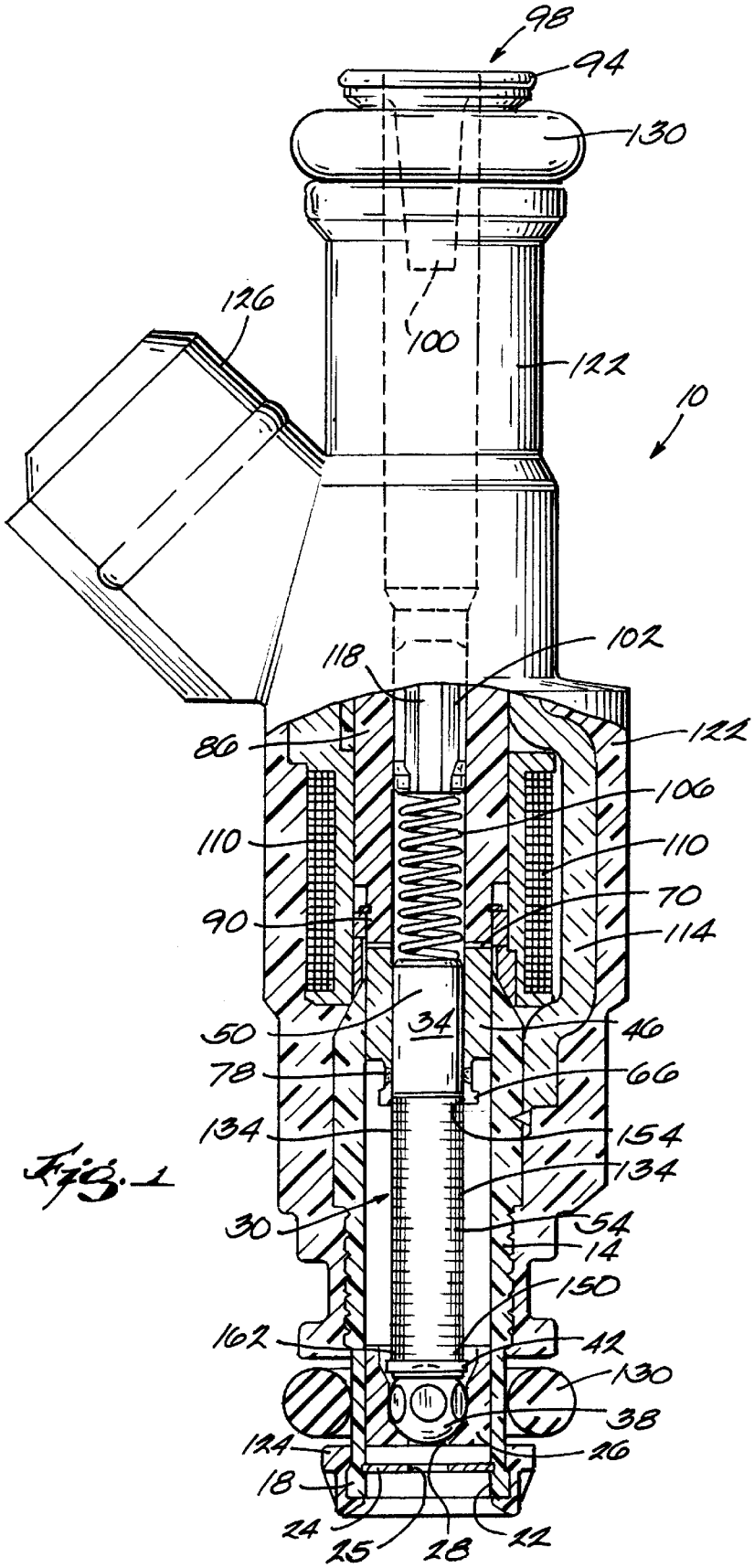
FIG. 1 is a partially cut away elevation view of a fuel injector embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

FIG. 1 illustrates a fuel injector 10 embodying the invention. The fuel injector 10 includes a jacket 14. The jacket 14 has a lower end 18 with an opening 22 for communicating with a combustion chamber (not shown). The opening 22 can communicate directly with the combustion chamber (i.e., a direct injection system), or indirectly via an air/fuel mixing chamber (not shown) (i.e., a port injection system). As used herein and in the appended claims, the terms "upper," "lower," "above," and "below" are used only for purposes of illustration and do not imply any particular orientation or configuration. An orifice plate 24 is positioned adjacent or inside the lower end 18 of the jacket 14. The orifice plate 24 includes an orifice 25 that is coaxial with the opening 22. Together, the orifice 25 in the orifice plate 24 and the opening 22 in the lower end 18 of the jacket 14 provide fluid communication between the fuel injector 10 and the combustion chamber or the fuel injector 10 and the air/fuel mixing chamber.

Figure 2:
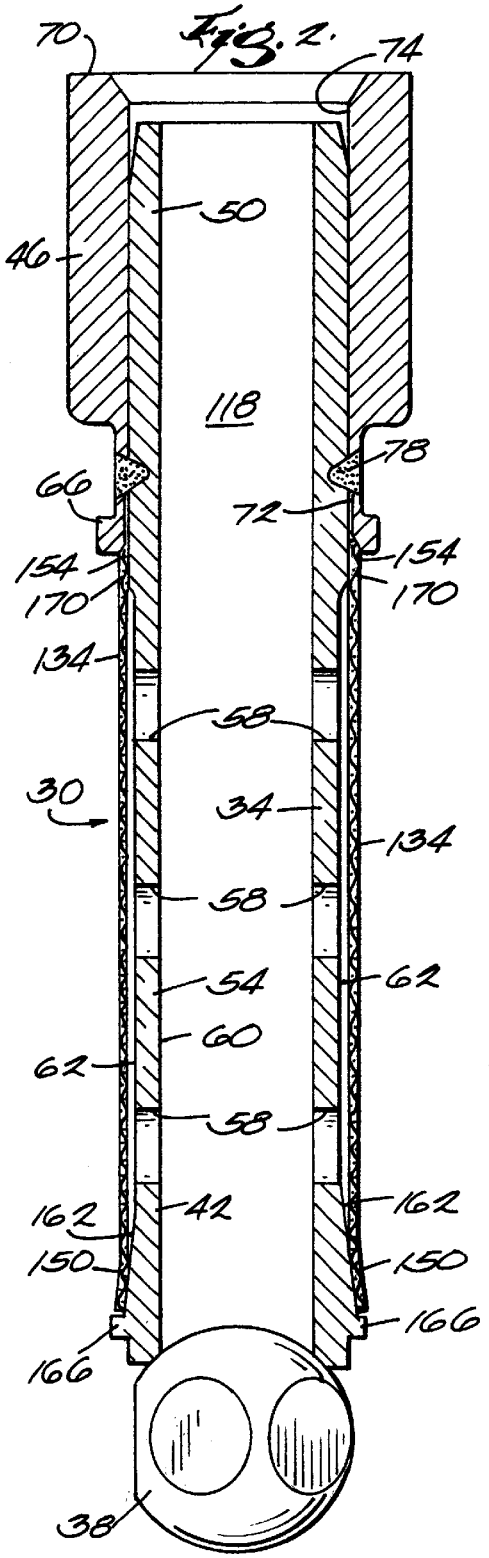
FIG. 2 is an enlarged section view of the needle valve assembly of the fuel injector illustrated in FIG. 1.

The jacket 14 also houses a valve seat 26 having an opening 28 adjacent the lower end 18. Additionally, the jacket 14 houses (see FIGS. 1 and 2) a needle valve apparatus with a needle valve assembly 30 having a tubular needle valve 34, a ball member 38 connected to a lower end 42 of the needle valve 34, and an armature 46 connected to an upper end 50 of the needle valve 34. As seen in FIG. 2, the needle valve 34 also includes a central body portion 54 having at least one, and preferably a plurality of holes or apertures 58 that provide fluid communication between a bore 60 of the tubular needle valve 34 and the interior space of the jacket 14. The needle valve 34 also includes an outer surface 62 that extends along the length of the needle valve 34 from the lower end 42 to the upper end 50. Features of the outer surface 62 of the needle valve 34 will be described in more detail below.

The ball member 38 is mounted on the lower end 42 of the needle valve 34 in any suitable manner to form the needle valve assembly 30 that is movable relative to the jacket 14. Typically the needle valve 34 and the ball member 38 are both metallic and the ball member 38 is welded to the needle valve 34 such that the ball member 38 seals the lower end 42 of the needle valve 34. Other suitable methods for securing the ball member 38 to the needle valve 34 are also contemplated. The ball member 38 is appropriately sized to be received in the valve seat 26. Together, the needle valve assembly 30 and the valve seat 26 operate as a fuel valve that selectively opens and closes the injector 10.

The armature 46 has a lower end 66, an upper end 70, and an inner surface 72 defining a bore 74. The upper end 50 of the needle valve 34 is received in the bore 74 and can be secured via a weld 78. Of course, any other suitable method of securing can be used, including using a press-fit or using adhesives. Features of the inner surface 72 of the armature 46 will be described in more detail below.

Referring to FIG. 1, the jacket 14 also houses a support tube 86. The support tube 86 includes a lower end 90 adjacent the upper end 70 of the armature 46 and an upper end 94 having a fuel inlet opening 98. The support tube 86 also includes a bore that houses a primary fuel filter 100 (shown hidden in FIG. 1), at least a portion of an adjustment sleeve 102, and at least a portion of a spring 106. The spring 106 is constrained between the lower end of the adjustment sleeve 102 and the upper end 50 of the needle valve 34 and/or a seat in the armature bore 74. The adjustment sleeve 102 is adjustable relative to the support tube 86 and biases the spring 106 against the needle valve 34 and/or armature 46, thereby biasing the needle valve assembly 30 into a first or closed position, wherein the ball member 38 rests in the valve seat 26 and blocks fluid communication between the fuel injector 10 and the combustion chamber or the fuel injector 10 and the air/fuel mixing chamber.

The injector 10 further includes an electromagnetic coil assembly 110 that encircles a portion of the jacket 14 and is housed inside a support frame 114. The electromagnetic coil assembly 110 can be selectively charged to create a magnetic field that attracts the armature 46, and thus the needle valve assembly 30, toward the lower end 90 of the support tube 86 (upward in FIG. 1) and into a second or open position. The biasing force of the spring 106 is overcome such that the ball member 38 is raised from the valve seat 26, allowing fuel to flow through the opening 28, through the orifice 25 in the orifice plate 24, and into the combustion chamber or the air/fuel mixing chamber. While in the open position, the upper end 70 of the armature 46 contacts the lower end 90 of the support tube 86. The needle valve assembly 30 remains in the open position until the charge is removed from the electromagnetic coil assembly 110, at which point the spring 106 biases the needle valve assembly 30 back into the closed position.

The bore of the support tube 86 defines the upper-most portion of a fuel passageway 118 that provides a path for fuel to travel through the fuel injector 10 and into the combustion chamber or the air/fuel mixing chamber. Fuel flows into the fuel inlet opening 98, through the primary fuel filter 100, the bore of the support tube 86, the bore in the adjustment sleeve 102, the armature bore 74, the needle valve bore 60, the apertures 58 in the needle valve 34, and into the interior space of the jacket 14. When the ball member 38 becomes unseated from the valve seat 26, the opening 28 is exposed. Fuel passes through the opening 28 and exits the injector 10 through the orifice 25. While not shown in the pictured embodiment, the injector 10 can also include an extension tube (not shown) that is press-fit and welded into the upper end of the jacket 14 or the upper end of the support tube 86.

The fuel injector 10 also includes a housing or overmolding 122 that surrounds portions of the support tube 86, the support frame 114 and the jacket 14. The housing 122 is preferably plastic and is preferably molded over the injector 10. In the preferred embodiment, the housing 122 is nylon or polyester, but any other suitable material can be used. The housing 122 protects the injector 10 from the environment. Additionally, the housing 122 is molded to form an electrical connection socket 126 around an external power lead (not shown) that extends from the electromagnetic coil assembly 110. An end cap 124 snaps onto the lower portion of the jacket 14. O-rings 130 are mounted adjacent both ends of the fuel injector 10 to seal the connections between the injector 10 and the injector sockets in the manifold (not shown).

As shown in FIGS. 1–5, the fuel injector 10 further includes a fuel filter screen 134 mounted on the needle valve assembly 30. The fuel filter screen 134 surrounds much of the needle valve 34 and filters fuel after the fuel passes through the apertures 58. The filter 134 is generally rectangular after manufacture and is then rolled into a generally tubular, shape,for assembly onto the needle valve assembly 30. The filter 134 includes (see FIG. 4) thousands of apertures or holes 136 preferably sized to stop particles larger than 0.050 millimeters in width. It is important to note that the holes 136 can be sized differently depending upon the specific filtering requirements. The holes 136 are preferably formed by chemical etching, or other suitable techniques. The filter 134 is burr-free, durable, and easy and inexpensive to manufacture, preferably from stainless steel. Alternatively, the filter 134 can be made from other suitable chemically resistive materials.

Figure 5:
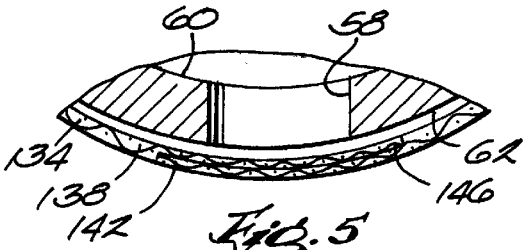
FIG. 5 is a partial cross-section view of the needle valve shown in FIG. 2.

As seen in FIG. 5, the filter 134 has body portion 138, a first edge portion 142, and a second edge portion 146. The filter 134 is sized such that when rolled up, the first and second edge portions 142 and 146 overlap one another and can be connected together to form the generally tubular configuration. The edge portions 142 and 146 can be connected together by welding or by any other suitable method. As shown in FIG. 5, the edge portions 142 and 146 each have a thickness that is approximately half the thickness of the body portion 138. When the filter 134 is rolled into a tubular shape, the combined thickness of the overlapped edges 142 and 146 is substantially equal to the thickness of the body portion 138.

Figure 4:
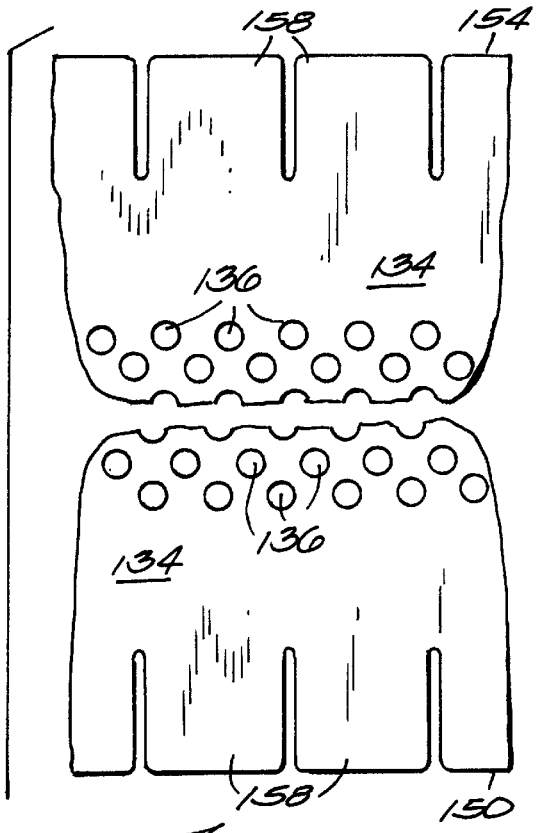
FIG. 4 is an enlarged partial view of the unrolled fuel filter screen illustrated in FIGS. 1 and 2.

As best seen in FIGS. 2 and 4, the filter 134 also includes lower and upper or first and second ends 150 and 154, respectively. The ends 150 and 154 are substantially mirror images of one another and could be reversed without changing the operation of the injector 10. Each of the ends 150 and 154 includes a plurality of finger-like tabs 158. The purpose of the tabs 158 will be described in more detail below.

The needle valve assembly 30 includes several features that cooperate with the filter 134 to help substantially seal and secure the filter 134 to the needle valve assembly 30 and to facilitate proper filtering. Referring to FIG. 2, the outer surface 62 of the needle valve 34 includes a tapered portion 162 adjacent the lower end 42. The tapered portion 162 tapers outwardly in the direction extending from the central body portion 54 to the lower end 42. The tapered portion 162 tapers to a circumference that is larger than the original circumference of the rolled filter 134 so that the lower end 150 of the filter 134, and more specifically the tabs 58 on the lower end 150, must deflect outwardly, thereby forming a tight fit with the tapered portion 162. The tight fit between the lower end 150 of the filter 134 and the tapered portion 162 of the needle valve 34 substantially seals and secures the lower end 150 of the filter 134 to the lower end 42 of the needle valve 34.

The tapered portion 162 terminates at a circumferential shoulder 166 that can act as a security stop during assembly, as described below. The outer surface 62 also includes a circumferential step 170 between the central body portion 54 and the upper end 50 that creates the necessary flow area between the central body portion 54 and the filter 134. The tapered portion 162, the circumferential shoulder 166, and the circumferential step 170 of the needle valve 34 can be formed using any suitable machining or forming techniques.

Figure 3:
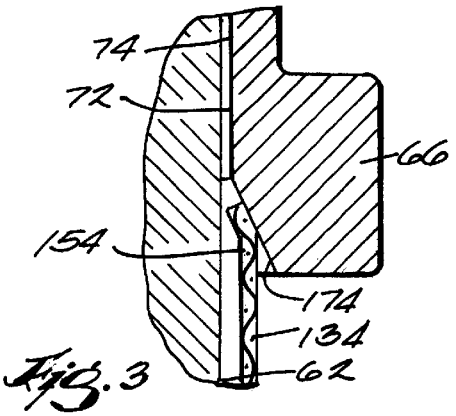
FIG. 3 is an enlarged partial section view of the needle valve assembly illustrated in FIG. 2.

Referring to FIG. 3, the inner surface 72 of the armature 46 also includes a tapered portion 174 adjacent the lower end 66. The tapered portion 174 tapers inwardly in the direction extending from the lower end 66 to the upper end 70. The tapered portion 174 tapers to a circumference that is smaller than the original circumference of the rolled filter 134 so that the upper end 154 of the filter 134, and more specifically the tabs 158 on the upper end 154, must deflect inwardly, thereby forming a tight fit with the tapered portion 174. The tight fit between the upper end 154 of the filter 134 and the tapered portion 174 of the armature 46 substantially seals and secures the upper end 154 of the filter 134 to the lower end 66 of the armature 46. The tapered portion 174 of the armature 46 can also be formed using any suitable machining or forming techniques.

The filter 134 is preferably installed in the following manner. First, the filter 134 is rolled into its tubular configuration by overlappingly connecting the first and second edge portions 142 and 146. Next, the rolled filter 134 is slid over (downwardly in FIGS. 1 and 2) the upper end 50 of the needle valve 34 so that the filter 134 slides over the circumferential step 170 and the outer surface 62 until the lower end 150 of the filter 134 engages the tapered portion 162 of the outer surface 62. The tapered portion 162 centers the filter 134 with respect to the needle valve 34 during assembly. As the filter 134 is forced further onto the tapered portion 162 and the fit becomes tighter between the lower end 150 and the tapered portion 162, the lower end 150, and more specifically the tabs 158 on the lower end 150, deflect outwardly.

The outward deflection of the tabs 158 on the lower end 150 substantially seals and secures the lower end 150 of the filter 134 on the lower end 42 of the needle valve 34. During normal assembly, the lower end 150 will become sealed against the tapered portion 162 prior to engaging the circumferential shoulder 166. Only when the filter 134 is advanced too far will the lower end 150 engage the circumferential shoulder 166, thereby substantially prohibiting further advancement of the filter 134. The circumferential shoulder 166 therefore acts as a security stop to substantially prevent improper assembly of the fuel injector 10.

With the lower end 150 of the filter 134 centered, sealed, and secured, the armature 46 is pressed onto the upper end 50 of the needle valve 34. As the armature 46 is pressed onto the upper end 50 (downward in FIG. 2), the lower end 66 of the armature 46 approaches the upper end 154 of the filter 134 until the tapered portion 174 of the inner surface 72 engages the upper end 154 of the filter 134. The tapered portion 174 of the armature 46 also helps center the filter 134 during assembly. As shown in FIG. 3, the tapered portion 174 causes the upper end 154, and more specifically the tabs 158 on the upper end 154, to deflect inwardly. The inward deflection of the tabs 158 on the upper end 154 substantially seals and secures the upper end 154 of the filter 134 in place on the needle valve assembly 30. Finally, the armature 46 can be welded or otherwise secured in place on the needle valve 34.

With the lower end 150 secured on the lower end 42 of the needle valve 34 by the tight fit on the tapered portion 162, and the upper end 154 secured in place on the needle valve assembly 30 by the armature 46, the filter 134 is substantially prevented from moving upwardly or downwardly (as viewed with respect to FIGS. 1 and 2) relative to the needle valve assembly 30. Because the upper and lower ends 150 and 154 are substantially sealed, fuel must pass through the holes 136 in the filter 134. Debris too large to pass through the holes 136 will be successfully filtered and will not be permitted to pass around the sealed lower and upper ends 150 and 154. The tab-and-taper arrangements result in a filter 134 that is largely self-sealing at both ends when assembled with the needle valve assembly 30. In addition, the tab-and-taper arrangement results in a filter 134 that is largely self-centering during assembly with the needle valve assembly 30. These advantages make assembly of the injector 10 easier and less expensive than the assembly of prior art injectors. Additionally, the filter 134 is positioned to filter fuel as close to the engine as possible.

It is important to note that the invention described herein may be used with any type of fuel injector employing a needle valve, and should not be limited to the specific fuel injector configuration shown in the figures. It is also important to understand that other methods of assembling the filter 134 on the needle valve assembly 30 can be used. For example, instead of rolling the filter 134 into the substantially tubular configuration prior to sliding the filter 134 onto the needle valve 34, it is possible to assemble the filter 134 onto the needle valve 34 by wrapping the filter 134 around the needle valve 34 and then connecting the first and second edge portions 142 and 146. If this method is used, it is important that the filter 134 be wrapped tightly enough around the needle valve 34 so that the lower end 150 of the filter 134 is substantially sealed and secured to the needle valve 34 as described above.

Figure 6:
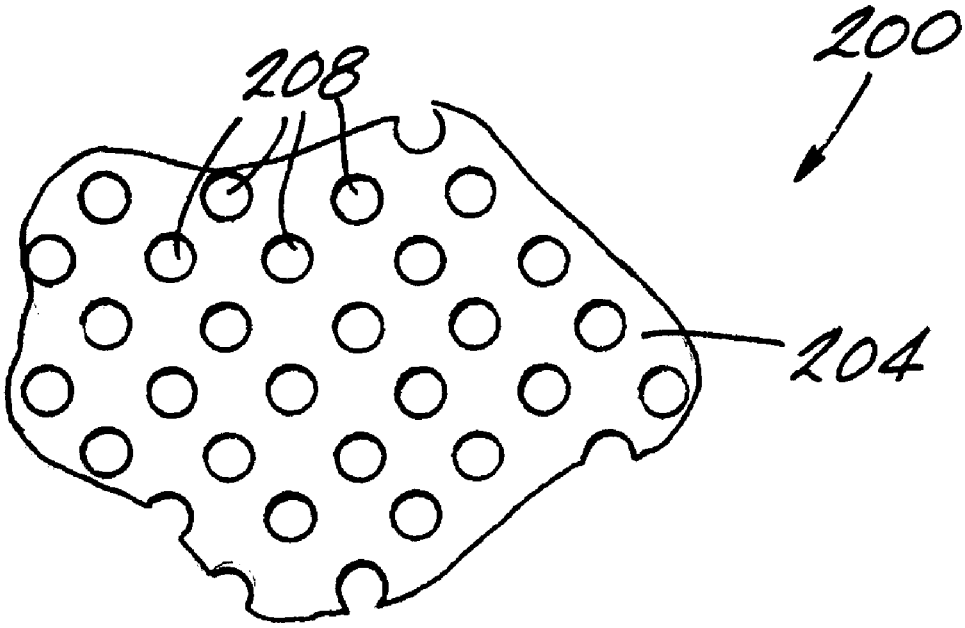
FIG. 6 is a partial side view of a needle apparatus that is an alternative embodiment of the present invention.

FIG. 6 illustrates a portion of a needle valve apparatus 200 that is an alternative embodiment of the present invention. The needle valve apparatus 200 does not include the fuel filter screen 134. Rather, the needle valve apparatus 200 includes a tubular needle valve 204 that has thousands of holes 208 formed directly in the wall of the needle valve 204. The holes 208 communicate between the bore of the needle valve 204 and the interior space of the jacket 14. The thousands of holes 208 act as the secondary fuel filter, thereby eliminating the need for a separate fuel filter screen 134. In other words, the needle valve 204 is substantially identical to the needle valve 34 with the exception that the holes 208 replace the apertures 58. The functions previously performed separately by the apertures 58 and the holes 136 are therefore combined and performed simultaneously by the holes 208. Like the holes 136 in the fuel filter screen 134, the holes 208 are preferably sized to stop particles larger than 0.050 millimeters in width. The holes 208 are preferably laser-drilled in the wall of the needle valve 204 by spinning the needle valve 204 and rapidly firing a laser-drilling tool as the needle valve 204 spins. Of course, other suitable techniques can also be used to form the holes 208. By forming the holes 208 directly in the needle valve 204, and thereby eliminating the fuel filter screen 134, the number of parts in the fuel injector 10 is reduced and assembly is simplified.

Various features of the invention are set forth in the following claims.

What is claimed is:

1. A fuel injector comprising:

a jacket;

a needle valve assembly mounted within the jacket, the needle valve assembly including at least one transverse aperture through which fuel can flow; and a generally tubular filter surrounding at least a portion of the needle valve assembly to filter fuel flowing through the aperture.

2. The fuel injector of claim 1, wherein the filter has an end that is forced against and deflected by a surface of the needle valve assembly to form a seal between the end of the filter and the needle valve assembly.

3. The fuel injector of claim 2, wherein the end of the filter includes a plurality of finger-like tabs that are deflected by the surface of the needle valve assembly.

4. The fuel injector of claim 1, wherein the needle valve assembly includes a needle valve having an outer surface, and wherein the filter has an end that is forced against and outwardly deflected by the outer surface of the needle valve to form a seal between the end of the filter and the outer surface of the needle valve.

5. The fuel injector of claim 4, wherein the end of the filter includes a plurality of finger-like tabs that are deflected outwardly by the outer surface of the needle valve.

6. The fuel injector of claim 4, wherein the outer surface includes a tapered portion that engages and outwardly deflects the end of the filter.

7. The fuel injector of claim 6, wherein the tapered portion includes a circumferential shoulder for engaging the end of the filter.

8. The fuel injector of claim 1, wherein the needle valve assembly includes an armature having an inner surface, and wherein the filter has an end that is forced against and inwardly deflected by the inner surface of the armature to form a seal between the end of the filter and the inner surface of the armature.

9. The fuel injector of claim 8, wherein the end of the filter includes a plurality of finger-like tabs that are deflected inwardly by the inner surface of the armature.

10. The fuel injector of claim 8, wherein the inner surface includes a tapered portion that engages and inwardly deflects the end of the filter.

11. The fuel injector of claim 1, wherein the filter is formed from a generally rectangular screen having a body portion with spaced-apart filtering apertures, and first and second edge portions that are overlappingly connected to form the generally tubular filter.

12. The fuel injector of claim 11, wherein the first and second edge portions each have a thickness that is less than the thickness of the body portion, such that when the first and second edge portions are overlappingly connected, the combined thickness of the overlapping edge portions is substantially equal to the thickness of the body portion.

13. The fuel injector of claim 1, further including a fuel passageway defined by a bore in the needle valve assembly, the at least one transverse aperture, the tubular filter, the jacket, and a valve seat defining an opening, and wherein fuel flows through the bore in the needle valve, exits the bore through the at least one transverse aperture, flows through the tubular filter and into an interior space defined by the jacket, and exits the injector through the opening defined by the valve seat.

14. A fuel injector comprising:

a jacket;

a needle valve mounted within the jacket and having an outer surface including at least one aperture through which fuel can flow;

an armature mounted to the needle valve and having an inner surface; and a filter surrounding at least a portion of the outer surface to filter fuel flowing through the aperture, the filter having a first end that is forced against and outwardly deflected by the outer surface of the needle valve to form a seal between the first end of the filter and the outer surface of the needle valve, and a second end that is forced against and inwardly deflected by the inner surface of the armature to form a seal between the second end of the filter and the inner surface of the armature.

15. The fuel injector of claim 14, wherein each of the first and second ends of the filter includes a plurality of finger-like tabs, and wherein the plurality of finger-like tabs on the first end are deflected outwardly by the outer surface of the needle valve and the-plurality of finger-like tabs on the second end are deflected inwardly by the inner surface of the armature.

16. The fuel injector of claim 14, wherein the outer surface further includes a tapered portion that engages and outwardly deflects the-first end of the filter.

17. The fuel injector of claim 16, wherein the tapered portion includes a circumferential shoulder.

18. The fuel injector of claim 14, wherein the inner surface includes a tapered portion that engages and inwardly deflects the second end of the filter.

19. The fuel injector of claim 14, wherein the filter is originally generally rectangular and includes a body portion with spaced-apart filtering apertures, and first and second edge portions that are overlappingly connected to surround the needle valve.

20. The fuel injector of claim 19, wherein the first and second edge portions each have a thickness that is less than the thickness of the body portion, such that when the first and second edge portions are overlappingly connected, the combined thickness of the overlapping edges is substantially equal to the thickness of the body portion.

21. The fuel injector of claim 14, further including a fuel passageway defined by a bore in the needle valve, the at least one aperture, the filter, the jacket, and a valve seat defining an opening, and wherein fuel flows through the bore in the needle valve, exits the bore through the at least one aperture, flows through the filter and into an interior space defined by the jacket, and exits the injector through the opening defined by the valve seat.

22. A method of assembling a fuel filter in a fuel injector, the method comprising:

providing a needle valve having an outer surface including at least one aperture through which fuel can flow;

rolling a generally rectangular fuel filter screen into a tubular shape; and surrounding at least a portion of the outer surface with the fuel filter screen so that fuel flowing through the aperture is filtered by the screen.

23. The method of claim 22, wherein the fuel filter screen is rolled around the outer surface.

24. The method of claim 22, wherein the outer surface further includes a tapered portion, and wherein surrounding at least a portion of the outer surface includes sliding the rolled filter screen over the outer surface and pressing the rolled filter screen into sealing engagement with the tapered portion.

25. The method of claim 24, wherein the rolled filter screen includes an end having a plurality of finger-like tabs, and wherein pressing the filter screen into sealing engagement with the tapered portion includes deflecting the finger-like tabs outwardly to substantially seal the end to the tapered portion.

26. The method of claim 22, further including providing an armature having an inner surface with a tapered portion, and pressing the armature onto the needle valve such that the tapered portion of the inner surface causes the rolled filter screen to sealingly engage a portion of the inner surface.

27. The method of claim 26, wherein the rolled filter screen includes an end having a plurality of fingerlike-tabs, and wherein pressing the armature on the needle valve includes deflecting the finger-like tabs inwardly to substantially seal the end to a portion of the inner surface.

28. The method of claim 22, wherein the fuel filter screen includes first and second edge portions and wherein rolling the fuel filter-screen into a tubular shape includes overlappingly connecting the first and second edge portions.

29. A fuel injector comprising:

a jacket;

a valve seat defining an opening; and a needle valve apparatus mounted within the jacket and engagable with the valve seat, the needle valve apparatus having a plurality of holes for filtering fuel flowing through the injector, each of the holes having a diameter sized to prevent passage therethrough of particles having widths of approximately 0.050 millimeters and larger.

30. The fuel injector of claim 29, wherein the needle valve apparatus includes:

a needle valve assembly including at least one transverse aperture through which fuel can flow; and a generally tubular filter surrounding at least a portion of the needle valve assembly and including the plurality of holes for filtering fuel flowing through the aperture.

31. The fuel injector of claim 30, wherein the plurality of holes are chemically etched into the tubular filter.

32. The fuel injector of claim 29, wherein the needle valve apparatus includes a needle valve assembly having:

a needle valve having a wall with the plurality of holes extending therethrough;

an armature mounted to the needle valve; and a ball member supported by the needle valve and engagable with the valve seat to selectively open and close the opening.

33. The fuel injector of claim 32, wherein the plurality of holes are laser-drilled in the wall of the needle valve.

34. The fuel injector of claim 32, further including a fuel passageway defined by a bore in the needle valve, the plurality of holes in the wall of the needle valve, the jacket, the ball member, and the valve seat, and wherein fuel flows through the bore in the needle valve, exits the bore through the plurality of holes in the wall of the needle valve and flows into an interior space defined by the jacket, flows around the ball member, and exits the injector through the opening defined by the valve seat.

* * * * *